US012680323B2

(12) United States Patent
Tang et al.

(10) Patent No.: US 12,680,323 B2
(45) Date of Patent: Jul. 14, 2026

(54) METHOD FOR CONTROLLING OUTRIGGER OF PUMP TRUCK, PUMP TRUCK AND METHOD FOR CONTROLLING PUMP TRUCK

(71) Applicant: SANY AUTOMOBILE MANUFACTURING CO., LTD., Changsha (CN)

(72) Inventors: Tingting Tang, Changsha (CN); Zhuo Huang, Changsha (CN); Wei Liu, Changsha (CN)

(73) Assignee: SANY AUTOMOBILE MANUFACTURING CO., LTD., Changsha (CN)

( * ) Notice: Subject to any disclaimer, the term of this patent is extended or adjusted under 35 U.S.C. 154(b) by 82 days.

(21) Appl. No.: 18/771,174

(22) Filed: Jul. 12, 2024

(65) Prior Publication Data

US 2024/0368906 A1 Nov. 7, 2024

Related U.S. Application Data

(63) Continuation of application No. PCT/CN2023/071991, filed on Jan. 13, 2023.

(30) Foreign Application Priority Data

Jan. 18, 2022 (CN) ..... 202210055255.2

(51) Int. Cl.
*E04G 21/04* (2006.01)

(52) U.S. Cl.
CPC ..... *E04G 21/0463* (2013.01)

(58) Field of Classification Search
CPC ..... B66C 23/78; E04G 21/0445
See application file for complete search history.

(56) References Cited

U.S. PATENT DOCUMENTS 5,580,095 A 12/1996 Fukumoto
2017/0144635 A1* 5/2017 Mayer ..... E04G 21/0445

FOREIGN PATENT DOCUMENTS

CN 101967883 A 2/2011
CN 102147959 A 8/2011
CN 102303570 A 1/2012
CN 103950433 A 7/2014
CN 104088465 A 10/2014
(Continued)

OTHER PUBLICATIONS

Gu et al., An automatic leveling control method for outrigger of pump truck, Technology and Enterprise, vol. 13, pp. 315-316, dated Jul. 6, 2012.

(Continued)

*Primary Examiner* — Scott A Browne
*Assistant Examiner* — Josephine Elizabeth Rich
(74) *Attorney, Agent, or Firm* — Westbridge IP LLC

(57) ABSTRACT

Disclosed are a method for controlling an outrigger of a pump truck, a method for controlling the pump truck and the pump truck. The method for controlling the outrigger of the pump truck of the present disclosure includes: obtaining a first tilting angle of an entire pump truck after a boom is unfolded; and in a case that the first tilting angle is larger than or equal to a first preset value, obtaining a current error count, and controlling the outrigger to act based on the current error count.

16 Claims, 3 Drawing Sheets

(56) References Cited

FOREIGN PATENT DOCUMENTS

| | | | | | |
|---|---|---|---|---|---|
| CN | 105156380 | A | | 12/2015 | |
| CN | 207089273 | U | | 3/2018 | |
| CN | 110863655 | A | * | 3/2020 | ..... E04G 21/0463 |
| CN | 111717173 | A | | 9/2020 | |
| CN | 111764654 | A | | 10/2020 | |
| CN | 212022603 | U | | 11/2020 | |
| CN | 112919339 | A | | 6/2021 | |
| CN | 113271410 | A | | 8/2021 | |
| CN | 113412355 | A | | 9/2021 | |
| CN | 113650587 | A | | 11/2021 | |
| CN | 114475532 | A | | 5/2022 | |
| EP | 1356910 | A1 | | 10/2003 | |
| JP | 2018104103 | A | | 7/2018 | |
| WO | 2019021123 | A1 | | 1/2019 | |
| WO | 2019175400 | A1 | | 9/2019 | |

OTHER PUBLICATIONS

International Search Report and Written Opinion issued in corresponding PCT Application No. PCT/CN2023/071991, dated May 5, 2023.

Zhou, Research on Electro-hydraulic Leveling System of Hybrid Arm Aerial Work Platform, Master's Thesis submitted to Chang'an University, dated Jan. 15, 2020.

Extended European Search Report issued in counterpart European Patent Application No. 23742797.6, dated Mar. 19, 2025.

* cited by examiner

METHOD FOR CONTROLLING OUTRIGGER OF PUMP TRUCK, PUMP TRUCK AND METHOD FOR CONTROLLING PUMP TRUCK

CROSS-REFERENCE TO RELATED APPLICATIONS

The present application is a continuation of International Application No. PCT/CN2023/071991, filed on Jan. 13, 2023, which claims priority to the Chinese Patent Application 202210055255.2, filed on Jan. 18, 2022. All of the aforementioned applications are incorporated herein by reference in their entireties.

TECHNICAL FIELD

The present disclosure relates to the field of concrete pump trucks technologies, and in particular, to a method for controlling an outrigger of a pump truck, the pump truck and a method for controlling the pump truck.

BACKGROUND

At present, when a pump truck is used for construction, in the case that a boom has been unfolded, an outrigger is not allowed to act. If the boom acts to tilt the pump truck excessive angle during construction, to ensure safety of the construction, the boom is first retracted to its primary support position, then the pump truck is leveled by the outrigger. Consequently, operation steps are cumbersome, construction flexibility is smaller, and thus construction efficiency is seriously affected.

SUMMARY

The present disclosure provides a method and a device for controlling an outrigger of a pump truck, and a method for controlling a pump truck, to solve the problem that in a conventional technology, when a boom is unfolded, the outrigger is not allowed to act, resulting in flexibility of construction is smaller.

The present disclosure provides a method for controlling and outrigger of a pump truck, including: obtaining a first tilting angle of an entire pump truck after a boom is unfolded; and in a case that the first tilting angle is larger than or equal to a first preset value, obtaining a current error count, and controlling the outrigger to act based on the current error count.

In accordance with the method for controlling the outrigger of the pump truck provided by the present disclosure, the step of controlling an outrigger to act based on the current error count includes: in a case that the current error count is less than a preset maximum allowable error count, controlling the outrigger to act.

In accordance with the method for controlling the outrigger of the pump truck provided by the present disclosure, the step of obtaining a current error count includes: obtaining a second tilting angle of the entire pump truck when the boom is at its primary support position, and calculating a first difference value between the first tilting angle and a second tilting angle; and in a case that the first difference value is larger than or equal to a second preset value, setting the current error count to be one.

In accordance with the method for controlling the outrigger of the pump truck provided by the present disclosure, after the step of, in a case that the first difference value is larger than or equal to a second preset value, setting the current error count to be one, the method further includes: obtaining a third tilting angle of the entire pump truck at a current moment; in a case that the third tilting angle is larger than the first tilting angle, setting the current error count to be: an accumulation of one plus a previous current error count; and in a case that the third tilting angle is less than or equal to the first tilting angle, setting not to count an error count.

In accordance with the method for controlling the outrigger of the pump truck provided by the present disclosure, the step of, in a case that the current error count is less than a preset maximum allowable error count, controlling the outrigger to act, further includes: determining the maximum allowable error count, where the step of, determining the maximum allowable error count, includes: obtaining a fourth tilting angle of the entire pump truck when the boom departs from its primary support position, and determining the maximum allowable error count based on the fourth tilting angle.

In accordance with the method for controlling the outrigger of the pump truck provided by the present disclosure, the method further includes: in a case that the first tilting angle is less than the first preset value, controlling the outrigger to act; and the step of, in a case that the first tilting angle is less than the first preset value, controlling the outrigger to act, further includes: in a case that the third tilting angle is larger than the first tilting angle, controlling the outrigger to stop acting.

In accordance with the method for controlling the outrigger of the pump truck provided by the present disclosure, after the step of, in a case that the third tilting angle is larger than the first tilting angle, controlling the outrigger to stop acting, the method further includes: obtaining an operation instruction, and controlling the outrigger to operate according to an emergency mode or an observation mode based on the operation instruction.

The present disclosure further provides a pump truck, including a controller, an outrigger and a boom, wherein the controller is configured to execute following steps: obtaining a first tilting angle of an entire pump truck when a boom is unfolded; obtaining a current error count when the first tilting angle is larger than or equal to a first preset value; and controlling the outrigger to act based on the current error count.

The present disclosure further provides a method for controlling a pump truck, including: obtaining a second tilting angle of an entire pump truck when a boom is at its primary support position, and in a case that the second tilting angle is less than a third preset value, controlling the boom to be unfolded; obtaining a first tilting angle of an entire pump truck after a boom is unfolded; and in a case that the first tilting angle is larger than or equal to a first preset value, obtaining a current error count, and controlling the outrigger to act based on the current error count.

In accordance with the method for controlling the pump truck provided by the present disclosure, after the step of, controlling the boom to be unfolded, the method further includes: obtaining a fifth tilting angle of the entire pump truck when the boom is unfolded; and calculating a second difference value between the fifth tilting angle and the second tilting angle, and in a case that the second difference value is larger than a torsion angle, controlling the boom to stop acting.

According to the method for controlling the pump truck provided by the present disclosure, the outrigger is controlled to act based on a comparison result between the first tilting angle and the first preset value. Consequently, the outrigger may also act within a certain range to level the entire pump truck after a boom has been unfolded, and thus flexibility of construction is improved, and construction efficiency is also improved.

BRIEF DESCRIPTION OF THE DRAWINGS

In order to more clearly explain technical solutions of the present disclosure or technical solutions in existing technologies, the drawings needed in the description of embodiments or the existing technologies will be briefly introduced below. Obviously, the drawings described below are merely some of the embodiments of the present disclosure, and for a person with ordinary skill in the art, other drawings may also be obtained according to the provided drawings without creative labor.

DETAILED DESCRIPTIONS OF THE EMBODIMENTS

In order to make the objectives, technical solutions and advantages of the present disclosure more clearly, the technical solutions of the present disclosure will be described thoroughly and clearly with reference to the drawings. Obviously, the described embodiments are merely a portion of the embodiments of the present disclosure, but not all the embodiments. Based on the embodiments in the present disclosure, all other embodiments obtained by a person with ordinary skill in the art without creative labor belong to the protection scope of the present disclosure.

A feature in specification and claims of the present disclosure defined by a term "first" or "second" may explicitly or implicitly include one or more features. In the description of the present disclosure, unless otherwise specified, a term "a plurality of" means two or more.

A method and device for controlling an outrigger of a pump truck, and a method for controlling a pump truck of the present disclosure will be described with reference to FIGS. 1 to 5 hereinafter.

Figure 1:
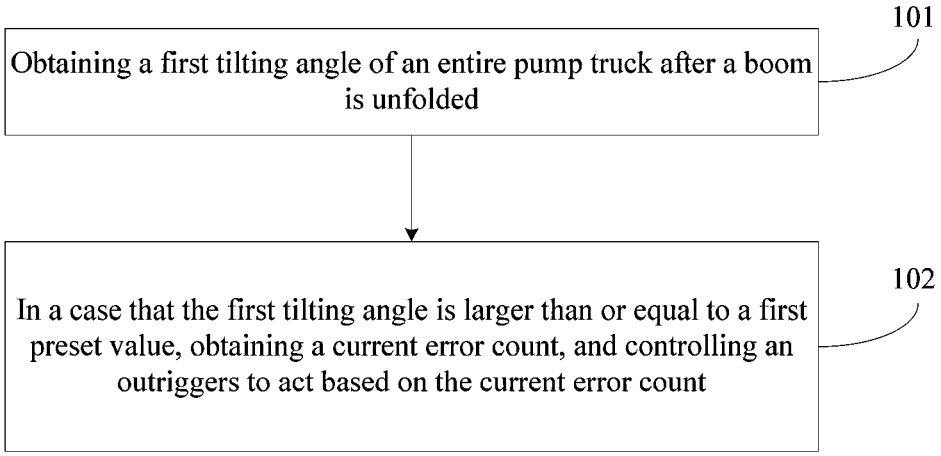
FIG. 1 is a flow diagram of a method for controlling an outrigger of a pump truck according to the present disclosure.
Figure 2:
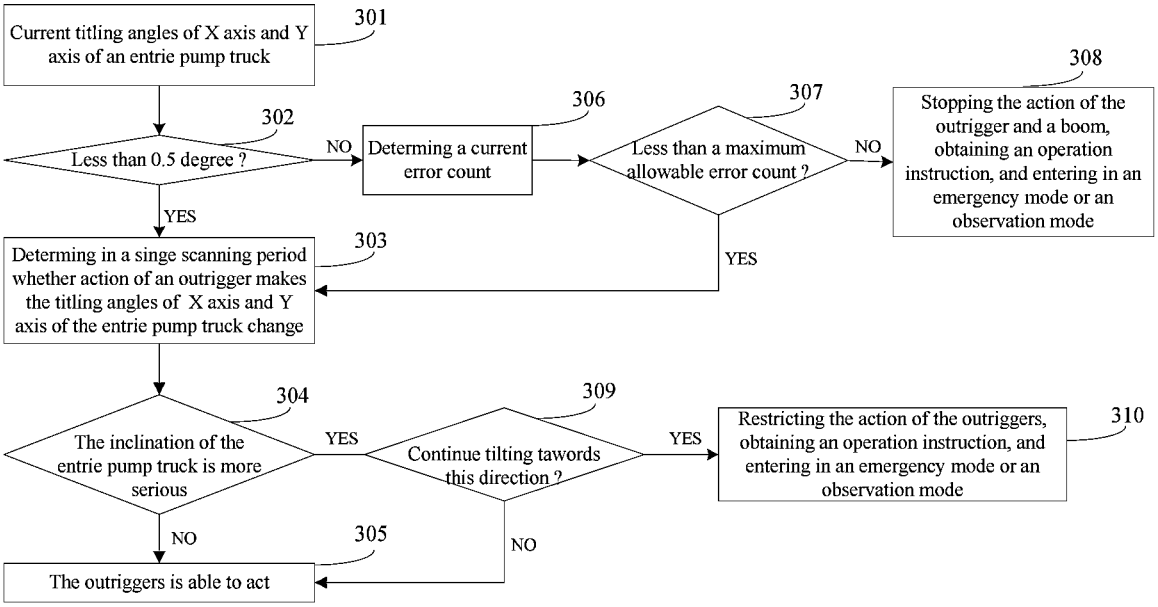
FIG. 2 is a logic diagram of a method for controlling an outrigger of a pump truck according to the present disclosure.

As shown in FIG. 1 and FIG. 2, in one embodiment of the present disclosure, the method for controlling the outrigger of the pump truck specifically includes the following steps.

Step 101: Obtaining a first tilting angle of an entire pump truck after a boom is unfolded.

Specifically, after the boom is unfolded, that is, the boom has completely departed from its primary support position, the outrigger is allowed to act under certain conditions to level the entire pump truck. At this moment, the first tilting angle of the entire pump truck relative to the level plane needs to be detected first. Specifically, the pump truck is provided with a gradienter for detecting the first tilting angle.

Step 102: In a case that the first tilting angle is larger than or equal to a first preset value, obtaining a current error count, and controlling the outrigger to act based on the current error count.

Specifically, the value of the first preset value varies depending on the type of pump truck. In the present embodiment, the first preset value is 0.5 degrees. When the first tilting angle is less than 0.5 degrees, the tilting angle of the entire pump truck is small, and the outrigger is allowed to act. After the outrigger acts, the tilting angle of the entire pump truck will change, then at this moment, in a case that the tilting angle of the entire pump truck relative to the level plane is larger than the first tilting angle, the outrigger is controlled to stop acting; or in a case that the tilting angle of the entire pump truck does not increase at this moment, that is, the tilting angle of the entire pump truck relative to the level plane is less than or equal to the first tilting angle, then the outrigger is controlled to continue acting to level the pump truck.

When the first tilting angle is larger than or equal to 0.5 degrees, at this time, the tilting angle of the entire pump truck is large, so it is necessary to determine whether the outrigger is able to continue acting according to the current error count. In a case that the current error count is less than the maximum allowable error count, the outrigger is allowed to continue acting. In a case that the current error count is larger than or equal to the maximum allowance count, the outrigger and the boom are controlled to stop acting. At this moment, in a case that it is confirmed by an operator, the outrigger may still act, then a system of the outrigger of the pump truck is controlled to operate in an emergency mode or an observation mode. Under these two modes, the outrigger may act.

According to the method for controlling the outrigger of the pump truck provided by the present disclosure embodiment, the outrigger is controlled to act by comparing the first tilting angle with the first preset value. Consequently, the outrigger may also act within a certain range to level the entire pump truck after the boom has been unfolded, and thus flexibility of construction is improved, and construction efficiency is also improved.

As shown in FIG. 2, in one embodiment of the present disclosure, the step of, in a case that the first tilting angle is larger than or equal to a first preset value, obtaining a current error count, and controlling the outrigger to act based on the current error count, further includes: in a case that the current error count is less than a preset maximum allowable error count, controlling the outrigger to act.

Specifically, when the first tilting angle is larger than or equal to the first preset value, it is necessary to determine whether the outrigger is able to continue acting based on a comparison result between the current error count and the preset maximum allowable error count. Specifically, the maximum allowable error count is an error count which is set according to the tilting angle of the entire pump truck when the boom departs from its primary support position and a sensor momentarily does not detect the boom. The corresponding maximum allowable error count is different with different tilting angle. The current error count refers to the number of errors which is set according to the current tilting angle of the entire pump truck after the boom is unfolded. In a case that the current error count is less than the maximum allowable error count, the outrigger may still act.

Further, in the present embodiment, after the step of, when the current error count is larger than or equal to a maximum allowable error count, controlling the outrigger to stop acting further includes: obtaining an operation instruction, and controlling the outrigger to operate according to an emergency mode or an observation mode based on the operation instruction.

Specifically, after the outrigger is controlled to stop acting, an operator needs to confirm whether the outrigger may still act. If, upon confirmation by the operator, the outrigger is still able to act, it will enter in the emergency mode or the observation mode.

According to the method for controlling the outrigger of the pump truck provided by the embodiment of the present disclosure, when the first tilting angle is equal to or larger than the first preset value, the outrigger is still able to act in a case that the current error count is less than the maximum allowable error count. Consequently, the flexibility of action of the outrigger is improved. Meanwhile, by determining whether the outrigger is able to act through a multi-layered judgment structure, the safety of the operation of the pump truck is improved.

Figure 3:
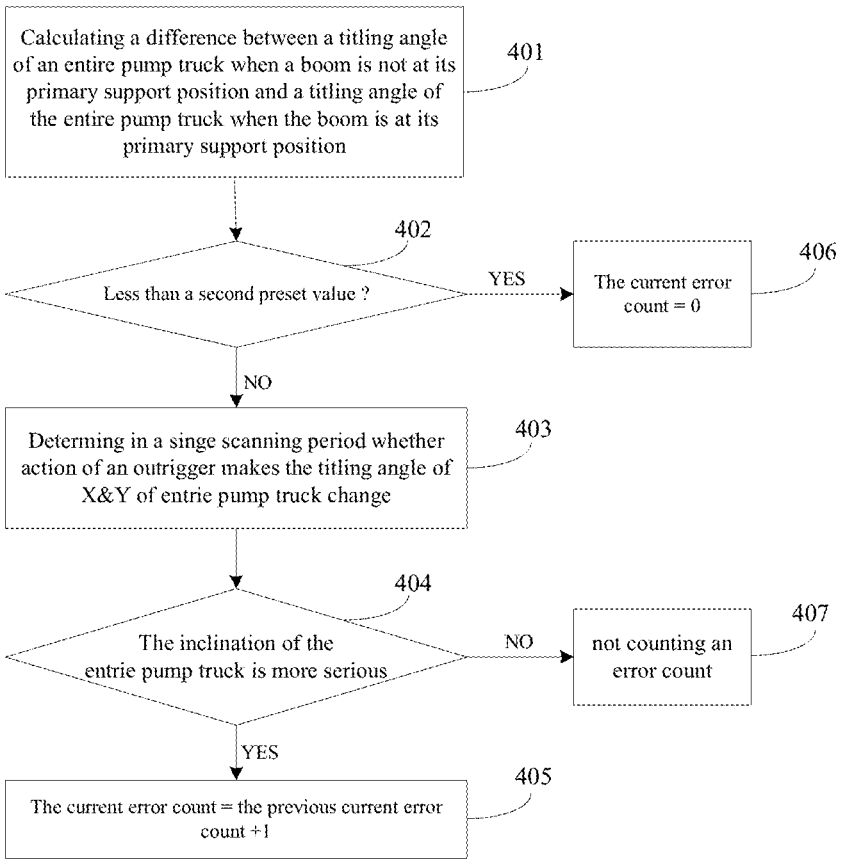
FIG. 3 is a logic diagram for determining a current error count.

As shown in FIG. 3, in one embodiment of the present disclosure, the step of obtaining a current error count includes: obtaining a second tilting angle of the entire pump truck when the boom is at its primary support position, and calculating a first difference value between the first tilting angle and a second tilting angle; determining whether the first difference is less than a second preset value; in a case that the first difference value is less than the second preset value, setting the current error count to be zero; and in a case that the first difference value is larger than or equal to the second preset value, setting the current error count to be one.

Specifically, in the present embodiment, the second preset value may be set based on the specific model of the pump truck. When the boom is at its main support position, the tilting angle of the entire pump truck is the second tilting angle. After the boom is unfolded, the tilting angle of the entire pump truck is the first tilting angle. In a case that the difference between the first tilting angle and the second tilting angle is less than the second preset value, the current error count is set to be zero. In a case that the difference between the first tilting angle and the second tilting angle is larger than or equal to the second preset value, the current error count is set to be one.

As shown in FIG. 3, further, in one embodiment of the present disclosure, after step of, in a case that the first difference value is larger than or equal to the second preset value, setting the current error count to be one, the method further includes: obtaining a third tilting angle of the entire pump truck at a current moment, and determining whether the third tilting angle is larger than the first tilting angle; in a case that the third tilting angle is larger than the first tilting angle, setting the current error count to be: an accumulation of one plus a previous current error count; and in a case that the third tilting angle is less than or equal to the first tilting angle, setting not to count an error count.

Specifically, after the boom is unfolded, and the first difference value is equal to or larger than the second preset value, the current error count is one, and the outrigger is still allowed to act at this moment. After the outrigger acts, the tilting angle of the entire pump truck relative to the level plane changes, and the tilting angle of the entire pump truck relative to the level plane is the third tilting angle at this moment. At this point, in the case that the third tilting angle is larger than the first tilting angle, it indicates that the action of the outrigger makes the tilt of the pump truck more serious. In this case, the current error count is set to be the accumulation of one plus the previous current error count, and thus the current error count at this time is two, and determination is made based on this. In a case that the accumulated current error count is larger than or equal to the maximum allowable error count, the outrigger is controlled to stop acting; in a case that the accumulated current error count is less than the maximum allowable error count, the outrigger may continue acting. In a case that the third tilting angle is less than or equal to the first tilting angle, it indicates that the action of the outrigger has effectively leveled the pump truck. At this moment, the error count is not counted, and the outrigger may continue acting.

Figure 4:
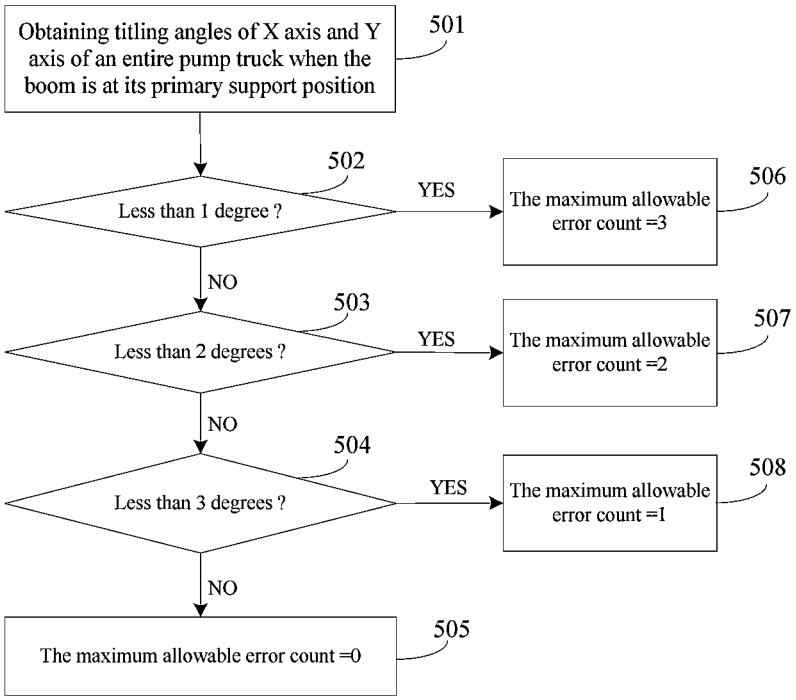
FIG. 4 is a logic diagram for determining a maximum allowable error count.

As shown in FIG. 4, further, in one embodiment of the present disclosure, the step of, in a case that the current error count is less than a preset maximum allowable error count, controlling the outrigger to act, further includes: determining the maximum allowable error count. The step of determining the maximum allowable error count includes: obtaining a fourth tilting angle of the entire pump truck when the boom departs from its primary support position, and determining the maximum allowable error count based on the fourth tilting angle.

Specifically, when the boom departs from its main support position, that is, at the moment the sensor does not detect the boom, the tilting angle of the entire pump truck relative to the level plane is the fourth tilting angle. This fourth tilting angle may be a variety of angles, and different tilting angles correspond to different maximum allowable error counts. When the tilting angle of the entire pump truck is large, the maximum allowable error count is less. Conversely, when the tilting angle of the entire pump truck is small, the maximum allowable error count is more.

Specifically, in a case that the fourth tilting angle is less than a fourth preset value, the maximum allowable error count is set to be 3; in a case that the fourth tilting angle is larger than or equal to the fourth preset value but less than a fifth preset value, the maximum allowable error count is set to be 2; in a case that the fourth tilting angle is larger than or equal to the fifth preset value and less than a sixth preset value, the maximum allowable error count is set to be 1; and in a case that the fourth tilting angle is larger than or equal to the sixth preset value, the maximum allowable error count is set to be 0.

Optionally, in one embodiment of the present disclosure, the fourth preset value is 1 degree; when the fourth tilting angle is less than 1 degree, the maximum allowable error count is 3. The fifth preset value is 2 degrees, when the fourth tilting angle is larger than or equal to 1 degree and less than 2 degrees, the maximum allowable error count is 2. The sixth preset value is 3 degrees, when the fourth tilting angle is larger than or equal to 2 degrees and less than 3 degrees, the maximum allowable error count is 1. In a case that the fourth tilting angle is larger than or equal to 3 degrees, the maximum allowable error count is 0.

For instance, when the boom departs from its main support position, it is detected that the fourth tilting angle between the entire pump truck and the level plane is 1.5 degrees, then after the boom is unfolded, when the outrigger act, the maximum allowable error count is 2. When the accumulated current error count is equal to 2, the outrigger stops acting.

As shown in FIG. 2, in one embodiment of the present disclosure, the method for controlling the outrigger of the pump truck further includes the following step: in a case that the first tilting angle is less than the first preset value, controlling the outrigger to act. This step further includes: in a case that the third tilting angle is larger than the first tilting angle, controlling the outrigger to stop acting.

Specifically, when the first tilting angle is less than the first preset value, the outrigger acts. At this moment, the tilting angle of the entire pump truck relative to the level plane changes. The gradienter detects the third tilting angle of the entire pump truck relative to the level plane. In a case that the third tilting angle is larger than the first tilting angle, it indicates that the action of the outrigger makes the tilting angle of the pump truck increase. In order to prevent the pump truck from side-turning over, it is necessary to control the outrigger to stop acting.

Further, in the present embodiment, after the step of, in a case that the third tilting angle is larger than the first tilting angle, controlling the outrigger to stop acting, the method further includes: obtaining an operation instruction, and controlling the outrigger to operate according to an emergency mode or an observation mode based on the operation instruction.

Specifically, after the outrigger is controlled to stop acting, the operator needs to confirm whether the outrigger is still able to act. Upon confirmation by the operator, in a case that the outrigger is still able to act, it enters in the emergency mode or the observation mode. Specifically, in a case that a fault of a sensor occurs, the emergency mode is entered. Under the emergency mode, the action of the outrigger is unrestricted, but it cannot operate under this mode for a long time. In a case that there is no fault of sensor, the observation mode is entered. Under the observation mode, the action of the outrigger is unrestricted. In a case that the tilting angle of the pump truck is too large, the boom may also be controlled to act to level the entire pump truck.

It should be noted that, in the present embodiment, the fault of the sensor refers to: a sensor signal is not received, a datum detected by the sensor exceeds a limit value, or the datum detected by the sensor is wrong and the like.

According to the method for controlling the outrigger of the pump truck provided by the embodiment of the present disclosure, in a case that the tilting angle of the pump truck does not increase after the outrigger acts, the outrigger may still continue acting. In a case that the tilting angle of the entire pump truck increases, it will enter in the emergency mode or the observation mode after being confirmed by the operator. Under these two modes, the outrigger may still act. Consequently, the flexibility of the action of the outrigger is improved, and at the same time, whether the outrigger is able to act or not is determined through the multi-layered judgment structure, which improves the safety of the operation of the pump truck.

The device for controlling the outrigger of the pump truck provided by the present disclosure will be described hereinafter, and the device for controlling the outrigger of the pump truck described below and the aforementioned method for controlling the outrigger of the pump truck may be referenced correspondingly.

Figure 5:
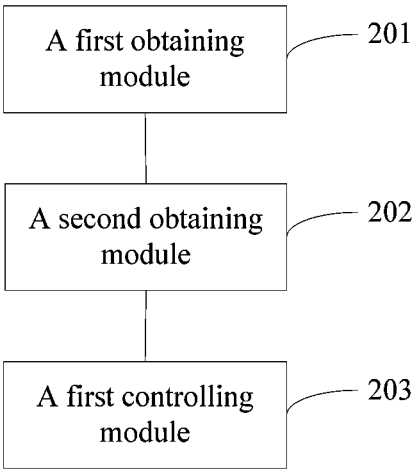
FIG. 5 is a schematic structural diagram of a device for controlling an outrigger of a pump truck according to the present disclosure.

As shown in FIG. 5, the embodiment of the present disclosure further provides a device (for example a controller) for controlling an outrigger of a pump truck, including: a first obtaining module 201, a second obtaining module 202 and a first controlling module 203. The first obtaining module 201 is configured to obtain a first tilting angle of an entire pump truck after a boom is unfolded. The second obtaining module 202 is configured to obtain a current error count when the first tilting angle is larger than or equal to a first preset value. The first controlling module 203 is configured to control the outrigger to act based on the current error count.

In one embodiment of the present disclosure, the device for controlling the outrigger of the pump truck also includes a second controlling module. The second controlling module is configured to control the outrigger to act when the current error count is less than a preset maximum allowable error count.

In one embodiment of the present disclosure, the device for controlling the outrigger of the pump truck further includes: a third obtaining module, a first calculation module and a first setting module. Specifically, the third obtaining module is configured to obtain a second tilting angle between the entire pump truck and a level plane when the boom is at its main support position. The first calculation module is configured to calculate a first difference between the first tilting angle and the second tilting angle. The first setting module is configured to set the current error count to be 1 in a case that the first difference is larger than or equal to a second preset value.

In one embodiment of the present disclosure, the device for controlling the outrigger of the pump truck further includes: a fourth obtaining module and a second setting module. Specifically, the fourth obtaining module is configured to obtain a third tilting angle of the current entire pump truck. The second setting module is configured to set the current error count to be an accumulation of one plus a previous current error count in a case that the third tilting angle is larger than the first tilting angle, or, set not to count an error count in a case that the third tilting angle is less than or equal to the first tilting angle.

In one embodiment of the present disclosure, the device for controlling the outrigger of the pump truck further includes a first determining module and a fifth obtaining module. The fifth obtaining module is configured to obtain a fourth tilting angle between the entire pump truck and the level plane when the boom departs from its main support position. The second determination module is configured to determine the maximum allowable error count based on the fourth tilting angle.

In one embodiment of the present disclosure, the device for controlling the outrigger of the pump truck further includes a sixth obtaining module and a third controlling module. The sixth obtaining module is configured to obtain an operation instruction, and the third controlling module is configured to control the outrigger to act according to an emergency mode or an observation mode based on this operation instruction.

The embodiment of the present disclosures also provides a method for controlling a pump truck, which specifically includes the following steps: obtaining a second tilting angle of an entire pump truck when a boom is at its primary support position; and in a case that the second tilting angle is less than a third preset value, controlling the boom to be unfolded.

Specifically, when the boom is not unfolded, the outrigger may freely act to level the pump truck. When the boom needs to be unfolded, the tilting angle of the entire pump truck relative to the level plane should be detected first. In a case that this tilting angle is less than a preset value, the boom is allowed to be unfolded. It should be noted that, the third preset value may be set according to specific working conditions.

In one embodiment of the present disclosure, after the step of controlling the boom to be unfolded, the method further includes: obtaining a fifth tilting angle of the entire pump truck when the boom is unfolded, and calculating a second difference value between the fifth tilting angle and the second tilting angle. In a case that the second difference is larger than a torsion angle, the boom is to be controlled to stop acting.

Specifically, when the boom is unfolded, it is necessary to verify whether the difference between the current tilting angle of the entire pump truck and the tilting angle of the entire pump truck that the boom is at its primary support position is less than the torsion angle, and the torsion angle herein is a test limit value. In a case that the second difference is larger than the torsion angle, it indicates that an abnormal situation has occurred, and the boom should be controlled to stop acting.

It should be noted that, in the above-mentioned embodiments, according to the action sequence of the boom and the outrigger, the corresponding tilting angles of the entire pump truck at each moment are respectively: the second tilting angle when the boom is at its primary support position and is not unfolded; the fourth tilting angle at the moment that the boom departs from its primary support position; the fifth tilting angle during the process that the boom is unfolded; the first tilting angle after the boom is unfolded; and the third tilting angle after the boom is unfolded and the outrigger acts.

According to the method for controlling the pump truck provided by the embodiment of the present disclosure, when the boom is not unfolded, the boom is not allowed to unfold in a case that tilting angle of the entire pump truck is too large. When the boom is unfolded, it is necessary to calculate the difference between the current tilting angle of the entire pump truck and the tilting angle of the entire pump truck that the boom is at its primary support position. In a case that this difference is larger than the torsion angle, the boom is controlled to stop acting. According to the method for controlling the pump truck provided by the embodiment of the present disclosure, the boom is capable to be controlled to act based on the current situation, and thus safety of the construction is improved.

According to one embodiment of the present disclosure, after the step of, in a case that the second difference is larger than a torsion angle, controlling the boom to stop acting, the method further includes: obtaining an operation instruction, and controlling the outrigger to operate according to an emergency mode or an observation mode based on the operation instruction.

Specifically, after the outrigger is controlled to stop acting, an operator needs to confirm whether the outrigger may still act. If, upon confirmation by the operator, the outrigger is still able to act, it will enter in the emergency mode or the observation mode.

Further, when entering in the emergency mode or the observation mode, the action of the boom is unrestricted under the emergency mode, but it cannot operate under this mode for a long time. In a case that no fault of a sensor occurs, the observation mode is entered. Under the observation mode, the action of the outrigger action is unrestricted, and in a case that tilting angle of the entire pump truck is too large, the boom may also be controlled to act to level the pump truck.

Finally, it should be explained that the aforementioned embodiments are merely used for illustrating the technical solutions of the present disclosure, but not intend to limit it. Although the present disclosure has been described in details with reference to the foregoing embodiments, it should be understood by a person skilled in the art that modifications to the described technical solutions or equivalent substitutions of some technical features in the foregoing embodiments are still feasible. These modifications or substitutions do not make the essence of the corresponding technical solutions deviate from the spirit and scope of the technical solutions of each embodiment of the present disclosure.

What is claimed is:

1. A method for controlling an outrigger of a pump truck, comprising:

obtaining a first tilting angle of an entire pump truck after a boom is unfolded; and in a case that the first tilting angle is larger than or equal to a first preset value, obtaining a current error count, and controlling the outrigger to act based on the current error count, wherein the step of controlling an outrigger to act based on the current error count comprises:

in a case that the current error count is less than a preset maximum allowable error count, controlling the outrigger to act; and the step of obtaining a current error count comprises:

obtaining a second tilting angle of the entire pump truck when the boom is at its primary support position, and calculating a first difference value between the first tilting angle and the second tilting angle; and in a case that the first difference value is larger than or equal to a second preset value, setting the current error count to be one.

2. The method for controlling the outrigger of the pump truck according to claim 1, wherein after the step of, in a case that the first difference value is larger than or equal to a second preset value, setting the current error count to be one, the method further comprises:

obtaining a third tilting angle of the entire pump truck at a current moment;

in a case that the third tilting angle is larger than the first tilting angle, setting the current error count to be: an accumulation of one plus a previous current error count; and in a case that the third tilting angle is less than or equal to the first tilting angle, setting not to count an error count.

3. The method for controlling the outrigger of the pump truck according to claim 2, wherein the step of, in a case that the current error count is less than a preset maximum allowable error count, controlling the outrigger to act, comprises:

determining the maximum allowable error count.

4. The method for controlling the outrigger of the pump truck according to claim 3, wherein the step of determining the maximum allowable error count comprises:

obtaining a fourth tilting angle of the entire pump truck when the boom departs from its primary support position, and determining the maximum allowable error count based on the fourth tilting angle.

5. The method for controlling the outrigger of the pump truck according to claim 4, wherein the determining the maximum allowable error count based on the fourth tilting angle comprises:

in a case that the fourth tilting angle is less than a fourth preset value, the maximum allowable error count is set to be 3;

in a case that the fourth tilting angle is larger than or equal to the fourth preset value but less than a fifth preset value, the maximum allowable error count is set to be 2;

in a case that the fourth tilting angle is larger than or equal to the fifth preset value and less than a sixth preset value, the maximum allowable error count is set to be 1; and in a case that the fourth tilting angle is larger than or equal to the sixth preset value, the maximum allowable error count is set to be 0.

6. The method for controlling the outrigger of the pump truck according to claim 5, wherein the fourth preset value is 1 degree, the fifth preset value is 2 degrees, and the sixth preset value is 3 degrees.

7. The method for controlling the outrigger of the pump truck according to claim 1, wherein the first preset value is 0.5 degrees.

8. The method for controlling the outrigger of the pump truck according to claim 2, wherein the method further comprises:

in a case that the first tilting angle is less than the first preset value, controlling the outrigger to act.

9. The method for controlling the outrigger of the pump truck according to claim 8, wherein the step of, in a case that the first tilting angle is less than the first preset value, controlling the outrigger to act, comprises:

in a case that the third tilting angle is larger than the first tilting angle, controlling the outrigger to stop acting.

10. The method for controlling the outrigger of the pump truck according to claim 9, wherein after the step of, in a case that the third tilting angle is larger than the first tilting angle, controlling the outrigger to stop acting, the method further comprises:

obtaining an operation instruction, and controlling the outrigger to operate according to an emergency mode or an observation mode based on the operation instruction.

11. The method for controlling the outrigger of the pump truck according to claim 10, wherein the controlling the outrigger to operate according to an emergency mode or an observation mode based on the operation instruction comprises:

in a case that a fault of a sensor occurs, entering the emergency mode.

12. The method for controlling the outrigger of the pump truck according to claim 10, wherein the controlling the outrigger to operate according to an emergency mode or an observation mode based on the operation instruction comprises:

in a case that there is no fault of the sensor, entering the observation mode.

13. The method for controlling the outrigger of the pump truck according to claim 11, wherein the fault of the sensor refers to: a sensor signal is not received, a datum detected by the sensor exceeds a limit value, or the datum detected by the sensor is wrong.

14. A pump truck, comprising a controller, an outrigger and a boom, wherein the controller is configured to execute following steps:

obtaining a first tilting angle of an entire pump truck when a boom is unfolded;

obtaining a current error count when the first tilting angle is larger than or equal to a first preset value; and controlling the outrigger to act based on the current error count, wherein the step of controlling an outrigger to act based on the current error count comprises:

in a case that the current error count is less than a preset maximum allowable error count, controlling the outrigger to act; and the step of obtaining a current error count comprises:

obtaining a second tilting angle of the entire pump truck when the boom is at its primary support position, and calculating a first difference value between the first tilting angle and the second tilting angle; and in a case that the first difference value is larger than or equal to a second preset value, setting the current error count to be one.

15. A method for controlling a pump truck, comprising:

obtaining a second tilting angle of an entire pump truck when a boom is at its primary support position, and in a case that the second tilting angle is less than a second preset value, controlling the boom to be unfolded;

obtaining a first tilting angle of an entire pump truck after a boom is unfolded; and in a case that the first tilting angle is larger than or equal to a first preset value, obtaining a current error count, and controlling the outrigger to act based on the current error count, wherein after the step of, controlling the boom to be unfolded, the method further comprises:

obtaining a third tilting angle of the entire pump truck when the boom is unfolded; and calculating a second difference value between the third tilting angle and the second tilting angle, and in a case that the second difference value is larger than a torsion angle, controlling the boom to stop acting; and after the step of, in a case that the second difference value is larger than a torsion angle, controlling the boom to stop acting, the method further comprises:

obtaining an operation instruction, and controlling the outrigger to operate according to an emergency mode or an observation mode based on the operation instruction.

16. The method for controlling the pump truck according to claim 15, wherein the torsion angle is a test limit value.

* * * * *